US007386136B2

(12) United States Patent
Ohbayashi et al.

(10) Patent No.: US 7,386,136 B2
(45) Date of Patent: Jun. 10, 2008

(54) SOUND DETECTING MECHANISM

(75) Inventors: Yoshiaki Ohbayashi, Nara (JP); Mamoru Yasuda, Kobe (JP); Shinichi Saeki, Kashiwara (JP); Masatsugu Komai, Nishinomiya (JP); Kenichi Kagawa, Kawasaki (JP)

(73) Assignees: Hosiden Corporation, Osaka (JP); Tokyo Electron Limited, Tokyo (JP)

( * ) Notice: Subject to any disclaimer, the term of this patent is extended or adjusted under 35 U.S.C. 154(b) by 137 days.

(21) Appl. No.: 10/544,253

(22) PCT Filed: May 25, 2004

(86) PCT No.: PCT/JP2004/007090

§ 371 (c)(1),
(2), (4) Date: Aug. 2, 2005

(87) PCT Pub. No.: WO2004/107809

PCT Pub. Date: Dec. 9, 2004

(65) Prior Publication Data

US 2006/0145570 A1 Jul. 6, 2006

(30) Foreign Application Priority Data

May 27, 2003 (JP) ..... 2003-148918

(51) Int. Cl.
*H04R 25/00* (2006.01)

(52) U.S. Cl. ..... 381/174; 381/175; 381/191

(58) Field of Classification Search ..... 381/113, 381/116, 174, 175, 190, 191, 369; 367/170, 367/181, 140; 310/322, 334
See application file for complete search history.

(56) References Cited

U.S. PATENT DOCUMENTS

| | | | | |
|---|---|---|---|---|
| 5,146,435 | A * | 9/1992 | Bernstein | 367/181 |
| 5,208,789 | A * | 5/1993 | Ling | 367/181 |
| 5,452,268 | A * | 9/1995 | Bernstein | 367/181 |
| 5,889,872 | A | 3/1999 | Sooriakumar et al. | |
| 2002/0067663 | A1 | 6/2002 | Leoppert et al. | |
| 2003/0094047 | A1 | 5/2003 | Torkkeli | |

FOREIGN PATENT DOCUMENTS

| | | |
|---|---|---|
| JP | 7-50899 | 2/1995 |
| JP | 2001-025095 | 1/2001 |
| JP | 2002-27595 | 1/2002 |
| JP | 2003-153393 | 5/2003 |

* cited by examiner

*Primary Examiner*—Huyen Le
(74) *Attorney, Agent, or Firm*—The Webb Law Firm

(57) ABSTRACT

A sound detecting mechanism is provided which forms a diaphragm with a required thickness by thickness control and yet restrains distortion of the diaphragm to provide high sensitivity.

The sound detecting mechanism comprises a pair of electrodes forming a capacitor on a substrate A in which one of the electrodes is a back electrode C forming perforations Ca therein corresponding to acoustic holes and the other of the electrodes is a diaphragm B. The diaphragm B is mounted on the substrate A while the back electrode C is mounted in a position opposed to the diaphragm B across a void F to be supported by the substrate A, the back electrode C being formed by polycrystal silicon of 5 μm to 20 μm in thickness.

8 Claims, 5 Drawing Sheets

A: support substrate
B: diaphragm
C: back electrode
D: spacer
E: acoustic opening
F: void area 301: monocrystal silicon substrate
302: silicon oxide film
303: polycrystal silicon film
305: sacrificial layer
306: polycrystal silicon film
315: take-out electrode A: support substrate
B: diaphragm
C: back electrode
D: spacer
E: acoustic opening
F: void area 301: monocrystal silicon substrate
302: silicon oxide film
303: polycrystal silicon film
305: sacrificial layer
306: polycrystal silicon film
315: take-out electrode

SOUND DETECTING MECHANISM

BACKGROUND OF THE INVENTION

1. Field of the Invention

The present invention relates to a sound detecting mechanism comprising a pair of electrodes forming a capacitor on a substrate, in which one of the electrodes is a back electrode forming perforations therein corresponding to acoustic holes and the other of the electrodes is a diaphragm.

2. Description of Related Art

Conventionally, condenser microphones are frequently used in mobile phones, for example. A typical construction of condenser microphones is shown in FIG. 6. This condenser microphone comprises a metal capsule 100 including a plurality of perforations "h" corresponding to acoustic holes formed therein, a fixed electrode 300 and a diaphragm 500 provided inside the capsule to be opposed to each other with a spacer 400 therebetween to maintain a predetermined gap, a substrate 600 fixed and fitted to a rear opening of the capsule 100, and an impedance converting element 700 made of J-FET or the like and mounted to the substrate 600. With this type of condenser microphone, a high voltage is applied to a dielectric material formed on the fixed electrode 300 or the diaphragm 500 to be heated to generate electric polarization and produce an electret membrane allowing a residual electric charge to remain on a surface thereof (an electret membrane 510 is formed in a diaphragm body 520 made of metal or conductive film which constitutes the diaphragm 500 in FIG. 6), thereby to provide a construction that requires no bias voltage. When the diaphragm 500 is vibrated by sound pressure signals of a sound, a distance between the diaphragm 500 and the fixed electrode 300 is changed to vary capacitance. The variation of capacitance is outputted through the impedance converting element 700.

Another conventional sound detecting mechanism has the following construction. This sound detecting mechanism comprises a substrate (110) constituting a diaphragm and a substrate (108) constituting a back face plate (103) (corresponding to the back electrode of the present invention), both substrates being superimposed through an adhesive layer (109) and then adhered to each other through heat treatment. Then, the substrate (108) acting as the back face plate is ground to obtain a desired thickness. After an etching mask (112) is formed on each of the substrates (108) and (109), the substrates are treated with an alkali etching liquid thereby to obtain the diaphragm (101) and the back face plate (103). Next, the back face plate (103) is reticulated (corresponding to the perforations of the present invention). An insulating layer (111) is etched with hydrofluoric acid, with the back face plate (103) acting as an etching mask, thereby to form a void layer (104) (see Patent Document 1, for example: the reference numbers are quoted from the cited document.)

Patent Document 1: Japanese Patent Publication No. 2002-27595 (paragraph [0030] through [0035], FIG. 1 and FIG. 3).

In order to increase output (improve sensitivity) of the conventional microphone shown in FIG. 6, it is required to increase the capacitance between the fixed electrode 300 and the diaphragm 500. In order to increase the capacitance, an area of superimposition of the fixed electrode 300 and the diaphragm 500 should be increased. Alternatively, it will be effective to reduce the gap between the fixed electrode 300 and the diaphragm 500. However, an increase in the area of superimposition of the fixed electrode 300 and the diaphragm 500 would lead to an enlargement of the microphone per se. On the other hand, in the construction having the spacer 400 noted above, there is a limitation in reducing the distance between the fixed electrode 300 and the diaphragm 500.

Also, the electret condenser microphones often utilize a high polymeric organic substance such as FEP (Fluoro Ethylene Propylene) or the like in order to produce a permanent electric polarization. The microphone using such a high polymeric organic substance has poor heat resistance, and thus is hardly capable of enduring the heat in time of re-flow treatment when mounted on a printed board, for example. The microphone, therefore, cannot be given re-flow treatment when mounted on the printed board or the like.

In view of the above, as described in Patent Document 1, it is conceivable to employ a construction including a back electrode and a diaphragm formed on a silicon substrate by micro fabrication technique. A sound detecting mechanism having such a construction is compact and yet is capable of enhancing sensitivity by reducing the distance between the back electrode and the diaphragm. Further, the mechanism can undergo re-flow treatment while requiring a bias supply. However, according to the technique set forth in Patent Document 1, the diaphragm is formed by etching a monocrystal silicon substrate with an alkali etching liquid, which makes it difficult to control the thickness of the diaphragm. As a result, it is difficult to obtain a required thickness for the diaphragm.

In considering control of the thickness of the diaphragm here, it is effective to utilize a single crystal silicon on insulator (SOI) wafer to improve the controllability of the thickness of the diaphragm in the process of forming the diaphragm by etching the silicon substrate with the alkali etching liquid. More particularly, according to this method, a built-in oxide film of the SOI wafer can be utilized as a stop layer for etching with the alkali etching liquid, thereby to control the thickness of the diaphragm by selecting the thickness of an active layer of the SOI wafer.

As a different method to the above, it is conceivable to utilize, instead of using the SOI wafer, an SOI structure wafer in which silicon oxide film or silicon nitride film is formed on the monocrystal silicon substrate as an etching stop layer to function as a stop layer in time of etching with the alkali etching liquid, and polycrystal silicon is formed on the etching stop layer. With this SOI structure wafer, it becomes possible to stop etching with the etching stop layer when the silicon substrate is etched with the alkali etching liquid, thereby to enhance the controllability of the thickness of the diaphragm.

However, in the method utilizing the SOI wafer or the method utilizing the SOI structure wafer, the sound detecting mechanism has a construction with a plurality of materials (films or layers) laminated on monocrystal silicon acting as a base. Thus, while a relatively thin diaphragm can be formed with high accuracy by stopping etching with the etching stop layer to form the diaphragm, the diaphragm is distorted by an inner stress caused by a difference between coefficients of thermal expansion of the plurality of materials laminated on the monocrystal silicon, which might lead to a disadvantage of deteriorating the vibration characteristic to hamper vibrations faithful to sound pressure signals when the diaphragm contacts the back electrode or even when the diaphragm does not contact the back electrode.

SUMMARY OF THE INVENTION

The object of the present invention is to provide a rational construction for a sound detecting mechanism having a diaphragm with a required thickness by thickness control and yet restraining distortion of the diaphragm to realize high sensitivity.

The first characteristic feature of a sound detecting mechanism according to the present invention lies in comprising a pair of electrodes forming a capacitor on a substrate in which one of the electrodes is a back electrode forming perforations therein corresponding to acoustic holes and the other of the electrodes is a diaphragm, wherein the diaphragm is mounted on the substrate while the back electrode is mounted in a position opposed to the diaphragm across a void to be supported by the substrate, the back electrode being formed by polycrystal silicon of 5 μm to 20 μm in thickness.

[Function and Effect]

According to the above-noted construction, as in the construction where a relatively thin diaphragm is formed by etching the substrate having an etching stop layer formed thereon, for example, even when a stress caused by a difference of coefficients of thermal expansion between a plurality of materials forming the etching stop layer, the diaphragm and the like, acts on the diaphragm, the thickness of the back electrode formed in the position opposed to the diaphragm is selected to be a relatively large value, between 5 μm to 20 μm, thereby to enhance the mechanical strength of the diaphragm and restrain distortion of the diaphragm caused by the internal stress. Therefore, this will not cause any disadvantage that the diaphragm contacts the back electrode or the like. In the microphone shown in FIG. 1 as a specific construction (see Best Mode For Carrying Out the Invention for details such as the thickness of the film), as illustrated in FIG. 4, the thickness of the back electrode C (film thickness of the back electrode) is selected to be within a range of 5 μm to 10 μm to restrain the bending amount of the diaphragm B to 3 μm or less while the thickness of the back electrode C is selected to be within a range of 15 μm to 20 μm to restrain the bending amount of the diaphragm B to 1 μm or less. Further, the above-noted characteristic feature provides the construction that dispenses with an electret layer and is capable of enduring the heat in time of re-flow treatment when mounted on a printed board. As a result, even if the diaphragm has a reduced thickness by employing a simple construction of selecting the thickness of the back electrode, the phenomenon that distorts the diaphragm by the internal stress can be avoided and the sound detecting mechanism having high sensitivity and capable of enduring the heat in time of re-flow treatment can be provided. In particular, the construction where the thickness of the back electrode is selected to have a relatively large value as in the present invention may also provide an effect that a frequency characteristic such as resonance frequency can be controlled by appropriately selecting the thickness of the back electrode.

The second characteristic feature of the sound detecting mechanism according to the present invention lies in that the substrate comprises a support substrate having a monocrystal silicon substrate acting as the base thereof, and that a silicon substrate of (100) orientation is used as the monocrystal silicon substrate.

[Function and Effect]

According to the above-noted construction, it is possible to promote etching selectively in a direction of the orientation peculiar to the monocrystal silicon substrate of (100) orientation, which allows for fine etching faithful to an etching pattern. As a result, a required shaping process is realized.

The third characteristic feature of the sound detecting mechanism according to the present invention lies in that impurity diffusion treatment is executed on the diaphragm.

[Function and Effect]

According to the above-noted construction, impurity diffusion treatment is executed on the diaphragm thereby to control the stress of the diaphragm and further control the tension of the diaphragm by controlling the stress. As a result, a distortion of the diaphragm can be efficiently eliminated. In particular, in this construction, an effect is produced that a distortion of the diaphragm can be further efficiently eliminated by combination of the thickness of the diaphragm and the thickness of the back electrode.

The fourth characteristic feature of the sound detecting mechanism according to the present invention lies in that the substrate comprises a support substrate having a monocrystal silicon substrate acting as the base thereof, and that the support substrate consists of an SOI wafer.

[Function and Effect]

According to the above-noted construction, a built-in oxide film formed on the SOI wafer can be utilized as a stop layer for etching with an alkali etching solution by treatment executed on the SOI wafer. Also, it is possible to use a film already formed on the SOI wafer as the diaphragm or use a newly formed film as the diaphragm. As a result, the SOI wafer having the necessary film already formed thereon is used to readily provide the sound detecting mechanism.

The fifth characteristic feature of the sound detecting mechanism according to the present invention lies in that the SOI wafer has an active layer used as the diaphragm.

[Function and Effect]

According to the above-noted construction, the active layer already formed on the SOI wafer is used as the diaphragm, which dispenses with treatment for forming the diaphragm. As a result, the sound detecting mechanism can be readily provided without forming a new film representing the diaphragm.

The sixth characteristic feature of the sound detecting mechanism according to the present invention lies in that the diaphragm is formed of monocrystal silicon of 0.5 μm to 5 μm in thickness.

[Function and Effect]

According to the above-noted construction, a relatively thin diaphragm having the thickness of 0.5 μm to 5 μm is formed by using the monocrystal silicon based on the technique established for manufacturing an integrated circuit, thereby to allow the diaphragm to be vibrated in good response to sound pressure signals. As a result, the sound detecting mechanism having high sensitivity is provided.

The seventh characteristic feature of the sound detecting mechanism according to the present invention lies in that the support substrate consists of an SOI structure wafer including a silicon oxide film or a silicon nitride film formed on a monocrystal silicon substrate and a polycrystal silicon film formed on the silicon oxide film or the silicon nitride film.

[Function and Effect]

According to the above-noted construction, in the case where the polycrystal silicon film is formed on a top surface of the silicon oxide film or the silicon nitride film formed on the monocrystal silicon substrate, the silicon oxide film or the silicon nitride film can be used as the etching stop layer when the polycrystal silicon film or any film formed on an external surface thereof is formed as the diaphragm by etching the monocrystal silicon. As a result, the diaphragm may readily have a reduced thickness by selecting the film thickness, thereby to provide the sound detecting mechanism of high sensitivity. In particular, in the construction where the diaphragm is formed by the polycrystal silicon formed on an outer layer than the oxide silicon with the monocrystal silicon substrate being the base while the back electrode is formed by the polycrystal silicon having a sacrificial layer consisting of oxide silicon disposed in an outer side of the diaphragm, stress acts in a compressing direction caused by the coefficients of thermal expansion of the films other than the polycrystal silicon film forming the diaphragm with the reference to the coefficient of thermal expansion of the back electrode (polycrystal silicon). Since the silicon nitride film has a property of exerting the stress in a stretching direction, an effect can be provided to alleviate the stress acting on the diaphragm by balancing the stress in the compressing direction and the stress in the stretching direction by forming the silicon nitride film.

The eighth characteristic feature of the sound detecting mechanism according to the present invention lies in that the polycrystal silicon film formed on the SOI structure wafer is used as the diaphragm.

[Function and Effect]

According to the above-noted construction, since the polycrystal silicon film is used as the diaphragm, the diaphragm can be formed using the film formed on the SOI structure wafer without forming a special film. As a result, the processing steps in manufacture are reduced thereby to readily provide the sound detecting mechanism.

The ninth characteristic feature of the sound detecting mechanism according to the present invention lies in that the diaphragm is formed by the polycrystal silicon of 0.5 μm to 5 μm in thickness.

[Function and Effect]

According to the above-noted construction, it is possible to form the diaphragm having a relatively small thickness using the polycrystal silicon based on the technique established for manufacturing integrated circuits. As a result, the sound detecting mechanism having high sensitivity is realized.

DESCRIPTION OF THE PREFERRED EMBODIMENTS

An embodiment of the present invention will be described hereinafter with reference to the drawings.

Figure 1:
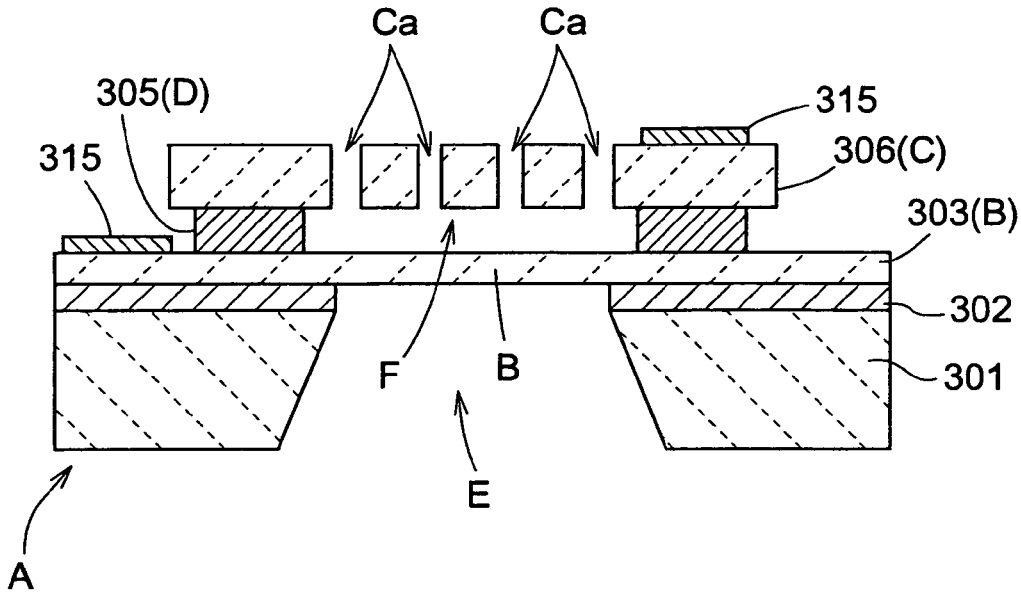
FIG. 1 shows a sectional view of a condenser microphone.

FIG. 1 is a sectional view of a silicon condenser microphone (simply referred to as a microphone hereinafter) exemplifying a sound detecting mechanism of the present invention. The microphone comprises a support substrate A having a base of monocrystal silicon, a diaphragm B and a back electrode C formed on the support substrate A from polycrystal silicon film made, and a sacrificial layer made of silicon oxide film ($SiO_2$) and arranged between the diaphragm B and the back electrode C to act as spacer D. This microphone allows the diaphragm B and the back electrode C to function as a capacitor, which is used to electrically take out variations of capacitance of the capacitor when the diaphragm B is vibrated by sound pressure signals.

The support substrate A in this microphone has a size of a square with one side 5.5 mm in length and around 600 μm in thickness. The diaphragm B has a size of a square with one side 2.0 mm in length and around 2 μm in thickness. The back electrode C has a plurality of perforations Ca formed therein corresponding to acoustic holes, each having a square with one side around 10 μm in length. In FIG. 1, the thickness of part of the films or layers is shown in an exaggerated way.

Figure 2:
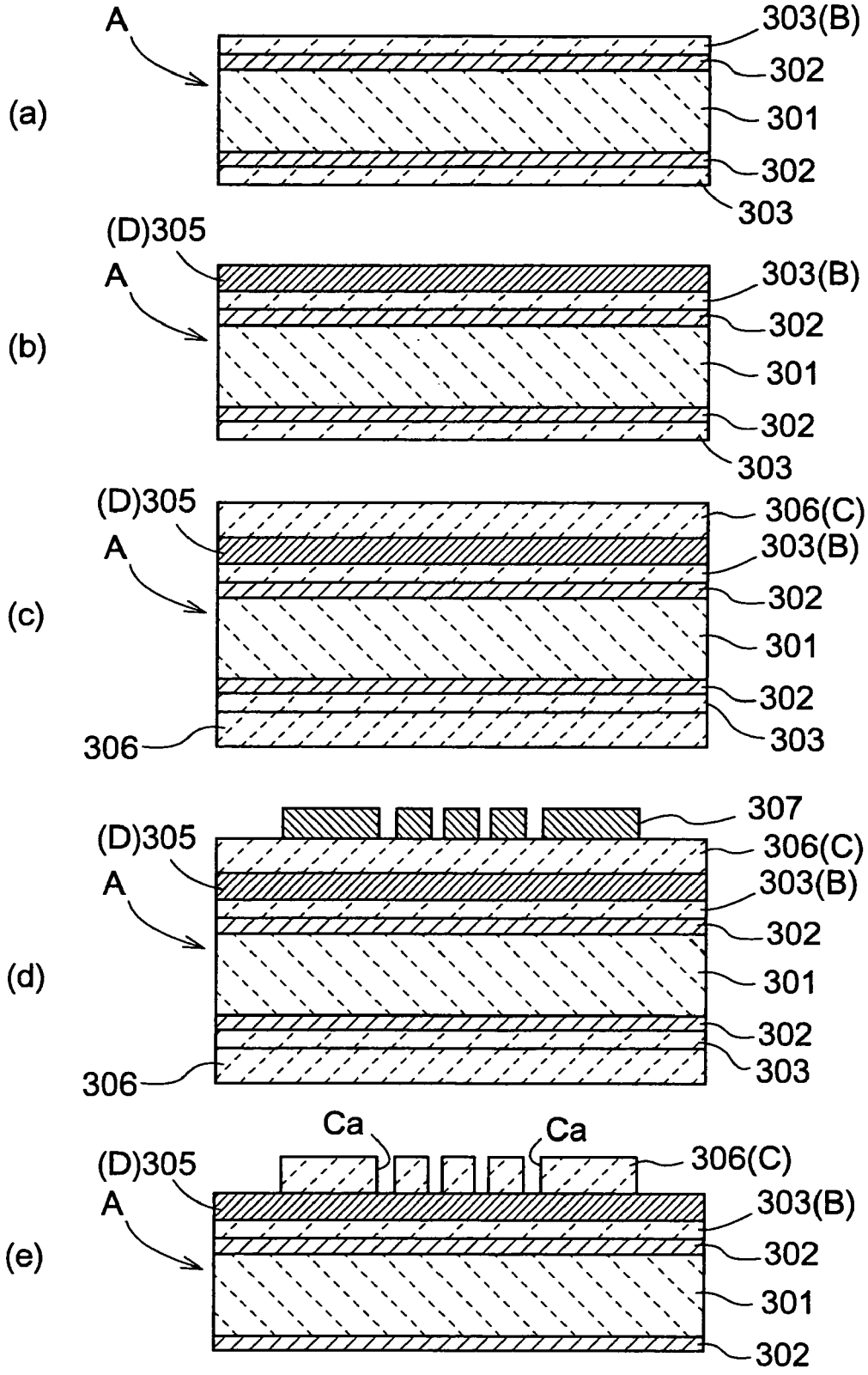
FIG. 2 shows a view consecutively showing steps for manufacturing the condenser microphone.
Figure 3:
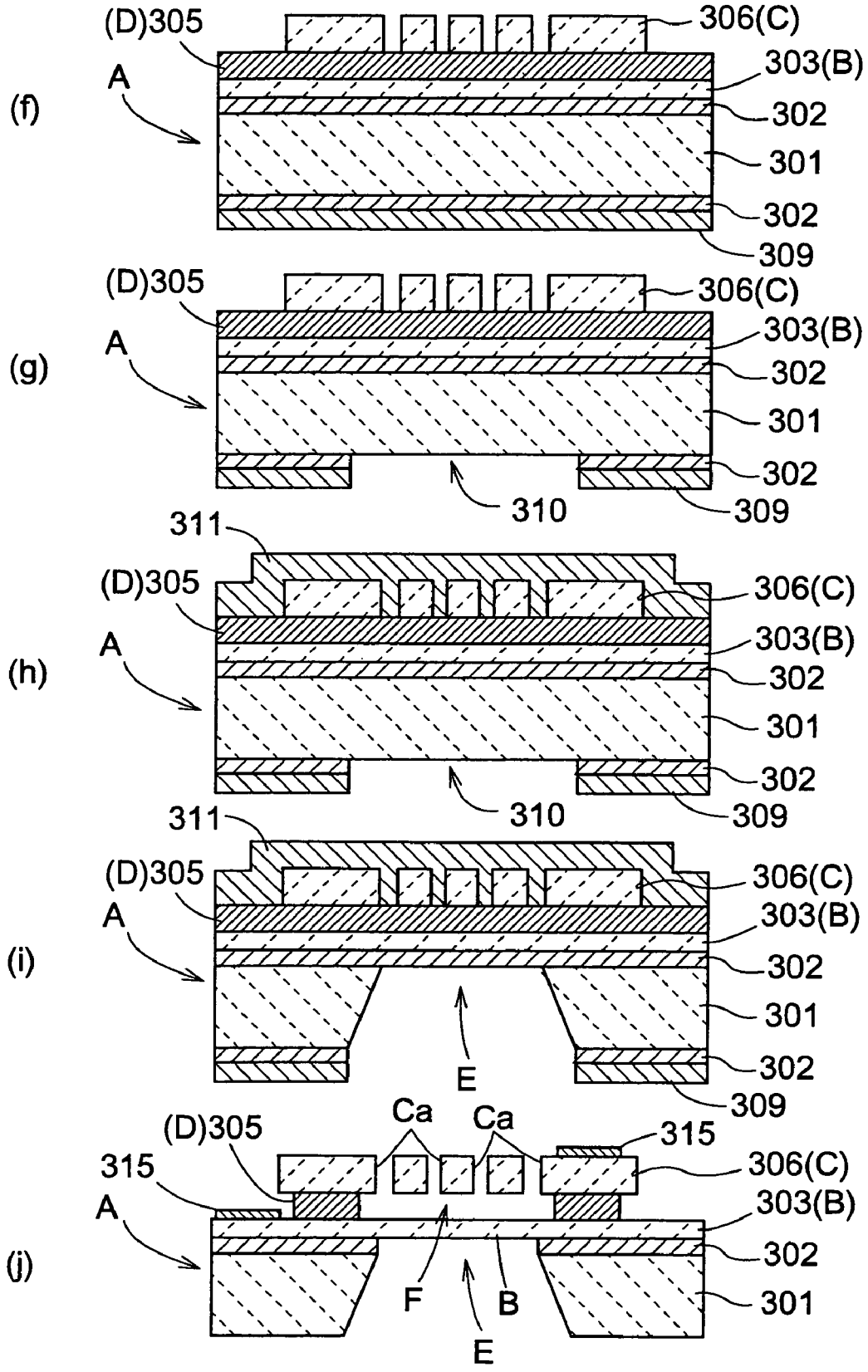
FIG. 3 shows view consecutively showing steps for manufacturing the condenser microphone.

The microphone includes an SOI structure wafer having a silicon oxide film 302 and a polycrystal silicon film 303 formed on a top surface of the monocrystal silicon substrate 301. On a top surface of the SOI structure wafer are formed a sacrificial layer 305 and a polycrystal silicon film 306. The top polycrystal silicon film 306 undergoes etching to form the back electrode C and the plurality of perforations Ca. Further, etching is executed on a portion extending from the back surface of the monocrystal silicon substrate 301 through the polycrystal silicon film 303 to form an acoustic opening E. The diaphragm B is formed by the polycrystal silicon film 303 exposed to the portion of the acoustic opening E, and further the sacrificial layer 305 undergoes etching to define a void area F between the diaphragm B and the back electrode C. The spacer D is formed by the sacrificial layer 305 remaining at outer peripheral portions of the diaphragm B after the etching. Steps for manufacturing the microphone will be described based on FIGS. 2(*a*) through 2(*e*), and FIGS. 3(*f*) through 3(*j*).

Step (a): The silicon oxide films 302 ($SiO_2$) of 0.8 μm in thickness are formed by thermal oxidation and the polycrystal silicon films 303 of 2 μm in thickness are formed by LP-CVD (Low Pressure Chemical Vapor Deposition) technique on opposite surfaces of the monocrystal silicon substrate 301 of (100) orientation having a thickness of 600 μm, thereby to form the support substrate A representing the SOI structure wafer.

According to the present invention, the SOI structure wafer is not limited to the construction shown in step (a) above. Instead, an SOI structure wafer may be used in which a silicon nitride film ($Si_3N_4$) is formed on the monocrystal silicon substrate 301 and the polycrystal silicon film 303 is formed on a top surface of the silicon nitride film. Also, the thickness of the polycrystal silicon film 303 is not limited to 2 μm, but may be within the range of 0.5 μm to 5 μm.

Step (b): The silicon oxide film ($SiO_2$) functioning as the sacrificial layer 305 of 5 μm in thickness is formed on a top surface of the support substrate A (upper side in the drawings) formed in step (a) by P-CVD (Plasma Chemical Vapor Deposition) technique.

Step (c): A polycrystal silicon film 306 of 5 μm to 20 μm in thickness is formed on a surface of the sacrificial layer 305 formed in step (b) by P-CVD technique. The polycrystal silicon film 306 constitutes the back electrode C and is formed on each of the opposite surfaces of the substrate.

Step (d): Photoresist is applied to the surface of the polycrystal silicon film 306 formed in step (c), and a resist pattern 307 is formed by removing unwanted portions by photolithographic technique.

Step (e): Etching is executed by RIE (Reactive Ion Etching) technique, using the resist pattern 307 formed in step (d) as a mask, to form a pattern of the back electrode C from the upper polycrystal silicon film 306. The plurality of perforations Ca are simultaneously formed when the pattern of the back electrode C is formed in this way. Also, the back side (lower side in the drawings) polycrystal silicon film 306 and the inner polycrystal silicon film 303 are removed by executing etching in this way.

Steps (f), (g): Next, a silicon nitride film 309 is formed on the back side (lower side in the drawings). Photoresist is applied to the surface of this film to form a resist pattern by removing unwanted portions by photolithographic technique. Then, etching is executed by RIE (Reactive Ion Etching) technique, using the resist pattern as a mask, to remove the silicon nitride film 309 and the silicon oxide film 302 which is an inner layer of the film 309. This produces an opening pattern 310 for silicon etching which realizes etching with an alkali etching solution executed in a step (i) described later.

Steps (h), (i): Next, a silicon nitride film 311 ($Si_3N_4$) is formed on the top side which acts as protective film. Subsequently, anisotropic etching is executed from the back side using an aqueous solution of TMAH (tetramethylammonium-hydroxide) as an etching solution to remove the silicon substrate 301, thereby to form the acoustic opening E. In this etching process, since the rate of etching the silicon oxide film 302 (built-in oxide film) is sufficiently lower than the rate of etching the silicon substrate 301, the silicon oxide film 302 functions as the stop layer for silicon etching.

Step (j): Next, the nitride film 311 (Si3N4) formed as the protective layer, the sacrificial layer 305, the silicon oxide film 302 exposed to the acoustic opening E, the silicon nitride film 309 and the silicon oxide film 302 remaining on the back side of the silicon substrate are removed by etching with HF (hydrogen fluoride). This results in the diaphragm B formed by the polycrystal silicon film 303, the void area F formed between the diaphragm B and the back electrode C, and the spacer D formed by the remaining sacrificial layer 305. Subsequently, Au (gold) is vapor-deposited to desired positions using a stencil mask to form a take-out electrode 315, thereby to complete the microphone.

Figure 4:
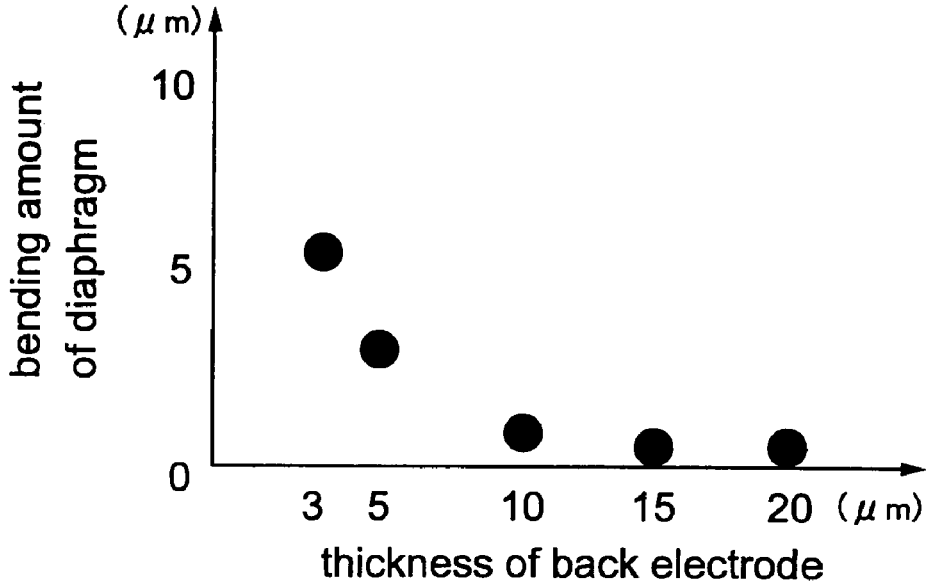
FIG. 4 shows a graphic presentation showing a relationship between thickness of a back electrode and amount of bending of a diaphragm.

With respect to the microphone manufactured according to the above process in which the thickness of the polycrystal silicon film 306 acting as the back electrode C is varied, FIG. 4 shows results of measuring amounts of bending of the diaphragm B by a laser displacement gauge. As shown, it can be understood that the bending amount of the diaphragm B is controlled to have tendencies to decrease with an increase in the thickness of the back electrode C. In particular, it can be understood that the bending amount of the diaphragm B is restrained to 3 μm or less by selecting the thickness of the back electrode C to be within the range of 5 μm to 10 μm, while the bending amount of the diaphragm B is restrained to 1 μm or less by selecting the thickness of the back electrode C to be within the range of 15 μm to 20 μm.

As described above, the sound detecting mechanism according to the present invention employs the construction including the diaphragm B and the back electrode C formed on the support substrate A by utilizing micro fabrication technique. As a result, the entire sound detecting mechanism may be made quite compact and readily incorporated to small devices such as mobile phones. Moreover, it is capable of enduring re-flow treatment at high temperature when it is mounted on a printed board, which makes it easy to assemble the apparatus.

Particularly, in the construction where the diaphragm B is formed by etching the support substrate A as in the present invention, the microphone with high sensitivity can be obtained by reducing the thickness of the diaphragm B. Since coefficients of thermal expansion of the materials constituting the plural films or layers formed on the support substrate A are different, the stress caused by the difference between the coefficients of thermal expansion is exerted on the diaphragm B in a compressing direction when the microphone is completed. As in the present invention, the polycrystal silicon film 306 is used for the back electrode C arranged in a position corresponding to the diaphragm B, and the back electrode C has an increased thickness (specifically 5 μm to 20 μm), thereby to enhance the mechanical strength of the diaphragm B as well as restrain distortion of the diaphragm B even when a force is exerted in a direction to distort the diaphragm B resulting from the internal stress. Also, the phenomenon to distort the diaphragm B by the internal stress can be avoided even if the diaphragm has a reduced thickness, thereby providing the microphone of high sensitively (one example of the sound detecting mechanism).

[Modified Embodiments]

Apart from the above-described embodiment, the present invention may be implemented as follows (common reference numbers and signs being used for the components in the following modified embodiments that have the same functions as in the foregoing embodiment).

(1) In the forgoing embodiment, the SOI structure wafer is used as the support substrate A, in which the silicon oxide film 302 is formed on the monocrystal silicon substrate 301, and then the polycrystal silicon film 303 is formed on the silicon oxide film 302. Instead, an SOI wafer may be used as the support substrate A including the active layer formed on an external surface of a built-in oxide film. Further, the active layer may represent the diaphragm B in the SOI wafer having he active layer, while the monocrystal silicon film may represent the diaphragm B in the SOI wafer having the monocrystal silicon film formed thereon. In particular, when the diaphragm B is formed by the monocrystal silicon film, it is desirable that the film thickness is selected to be within the range of 0.5 μm to 5 μm to obtain good sensitively.

Figure 5:
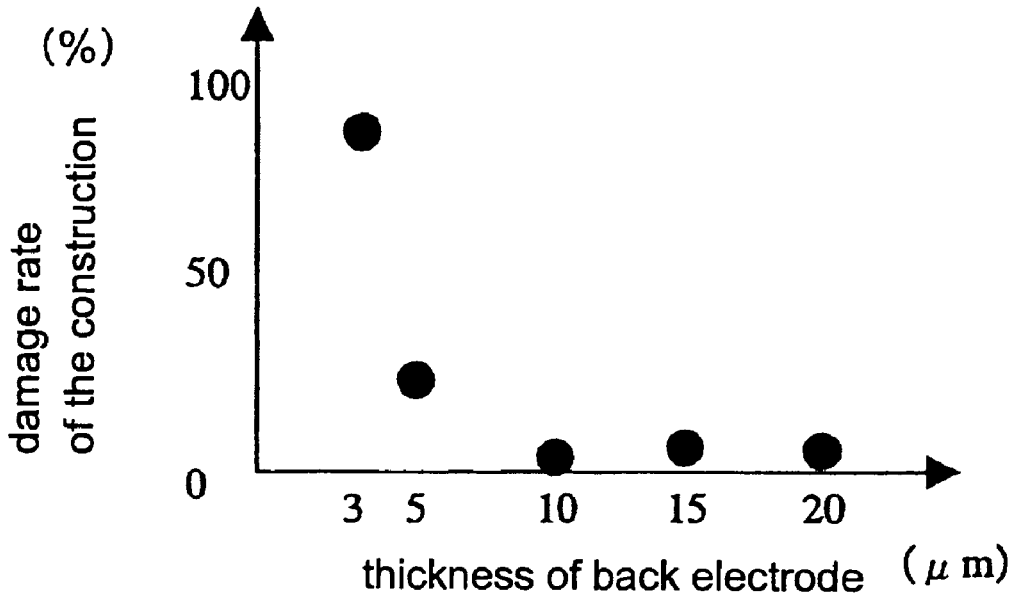
FIG. 5 shows a graphic presentation showing a relationship between thickness of the back electrode and damage rate of a structure.
Figure 6:
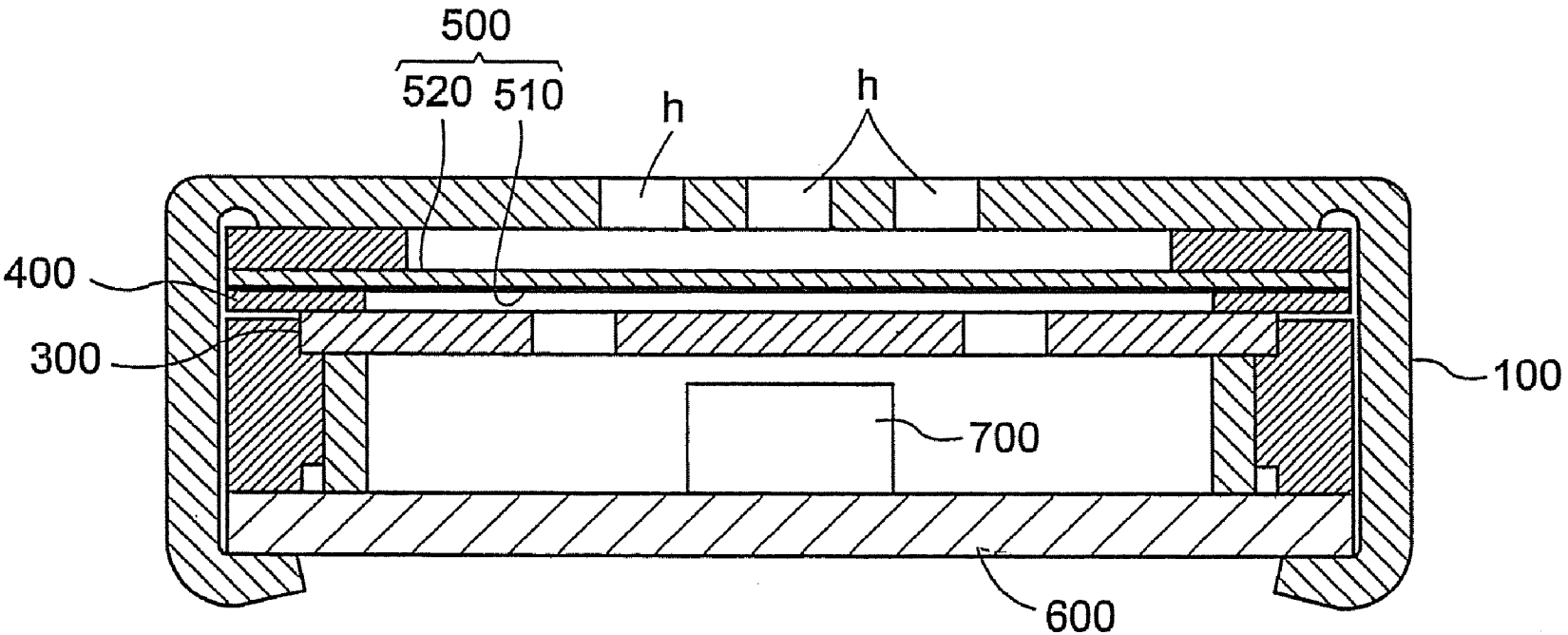
FIG.6 (PRIOR ART)
FIG. 6 shows a sectional view of a conventional condenser microphone.

(2) With respect to the silicon condenser microphones utilizing the SOI wafer as the support substrate A in which the thickness of the back electrode C is varied, FIG. 5 shows results of calculating the damage rate of the construction in time of manufacture. As shown in the diagram, since the internal stress of the diaphragm B per se is reduced when the SOI wafer is used, the bending amount of the diaphragm B can be reduced compared with the case of using the SOI structure wafer. Particularly, it is desirable from the viewpoint of securing mechanical strength that the thickness of the back electrode C is 5 μm or more.

(3) In the sound detecting mechanism according to the present invention, the material for the diaphragm B is not limited to polycrystal silicon or the active layer. The diaphragm B may be formed using a film having conductivity such as a metal film, or a construction including a film having conductivity laminated on an electrical insulating film such as a resin film. Specifically, it may be possible to use a high melting point material including tungsten when using a metal film.

(4) As described above, the present invention is aimed at reducing (restraining) the stress acting on the diaphragm B by selecting the thickness of the back electrode C. In addition to the construction having the back electrode C with an increased thickness in this way, the stress acting on the diaphragm B may also be controlled by applying impurity diffusion to the diaphragm B. In one specific example of such treatment, boron is introduced into the polycrystal silicon film 302 forming the diaphragm B by ion implantation technique with the energy of 30 kV and a dose of 2E16 $cm^{-2}$. Heat treatment is executed at 1150° C. in a nitrogen atmosphere for eight hours as an activated heat treatment, thereby to form the diaphragm B having a compressed stress. Therefore, by combination of the film thickness ratio between the silicon oxide film and the silicon nitride film acting as the stop layer for silicon etching by the alkali etching liquid with impurity diffusion as well as the thickness of the back electrode, the tension of the diaphragm B is synthetically controlled to balance the stress acting on the diaphragm B with the tension, which can release the tension acting on the diaphragm B and form the diaphragm B on which the necessary tension is exerted.

(5) It is also possible to form an integrated circuit on the support substrate A constituting the sound detecting mechanism. The integrated circuit functions to convert variations of capacitance between the diaphragm B and the back electrode C into electric signals for output. With the construction having such an integrated circuit, a take-out electrode 305 may be connected with the integrated circuit through a bonding wire or the like thereby to electrically connect between the diaphragm B, the back electrode C and the integrated circuit. With this construction, there is no need to form an electric circuit on the printed board or the like for converting variations of capacitance between the diaphragm B and the back electrode C into electric signals for output. This can minimize the size of the device and simplify the construction utilizing the sound detecting mechanism having the arrangement of the present invention.

According to the present invention, it is possible to provide a sound detecting mechanism which forms a diaphragm with a required thickness by thickness control and yet restrains distortion of the diaphragm to provide high sensitivity. This sound detecting mechanism may also be used as a sensor responsive to variations in aerial vibration and air pressure, besides a microphone.

The invention claimed is:

1. A sound detecting mechanism comprising a pair of electrodes forming a capacitor on a substrate in which one of the electrodes is a back electrode forming perforations therein corresponding to acoustic holes and the other of the electrodes is a diaphragm, wherein a multilayered assembly is mounted on the substrate, the multilayered assembly formed of the diaphragm, a sacrificial layer and the back electrode superposed in series by vapor deposition technique;

the sacrificial layer is etched relative to the multilayered assembly formed of the diaphragm, the sacrificial layer and the back electrode, thereby defining a void area between the diaphragm and the back electrode, with the sacrificial layer remaining at outer peripheral portions of the void area; and the back electrode being formed by polycrystal silicon of 5 μm to 20 μm in thickness; and the substrate comprises a single crystal silicon on insulator (SOI) structure wafer including a silicon oxide film or a silicon nitride film formed on a monocrystal silicon substrate and a polycrystal silicon film formed on the silicon oxide film or the silicon nitride film.

2. The sound detecting mechanism of claim 1, wherein the substrate comprises a support substrate having a monocrystal silicon substrate acting as the base thereof, and a (100) silicon substrate is used as the monocrystal silicon substrate.

3. The sound detecting mechanism of claim 1, wherein an impurity diffusion treatment is executed on the diaphragm.

4. The sound detecting mechanism of claim 1, wherein the substrate comprises a support substrate having a monocrystal silicon substrate acting as the base thereof; and the support substrate consists of a single crystal silicon on insulator (SOI) wafer.

5. The sound detecting mechanism of claim 4, wherein the single crystal silicon on insulator (SOI) wafer has an active layer used as the diaphragm.

6. The sound detecting mechanism of claim 4, wherein the diaphragm is formed of monocrystal silicon of 0.5 μm to 5 μm in thickness.

7. The sound detecting mechanism of claim 1, wherein the polycrystal silicon film formed on the single crystal silicon on insulator (SOI) structure wafer is used as the diaphragm.

8. The sound detecting mechanism of claim 1, wherein the diaphragm is formed of polycrystal silicon of 0.5 μm to 5 μm in thickness.

* * * * *